US008385791B2

(12) United States Patent
Ito et al.

(10) Patent No.: US 8,385,791 B2
(45) Date of Patent: Feb. 26, 2013

(54) DEVELOPER REGULATING MEMBER, DEVELOPING DEVICE, IMAGE FORMING APPARATUS AND MANUFACTURING METHOD OF DEVELOPER REGULATING MEMBER

(75) Inventors: Junichi Ito, Tokyo (JP); Yukiyoshi Oda, Tokyo (JP); Masahiro Kawano, Tokyo (JP); Kazuhisa Fukamachi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 331 days.

(21) Appl. No.: 12/659,075

(22) Filed: Feb. 24, 2010

(65) Prior Publication Data

US 2010/0215410 A1 Aug. 26, 2010

(30) Foreign Application Priority Data

Feb. 26, 2009 (JP) ..... 2009-044057

(51) Int. Cl.
*G03G 15/08* (2006.01)

(52) U.S. Cl. ..... 399/284; 399/264; 399/273; 399/274; 399/283

(58) Field of Classification Search ..... 399/264, 399/273, 274, 283, 284
See application file for complete search history.

(56) References Cited

U.S. PATENT DOCUMENTS

| | | | | |
|---|---|---|---|---|
| 2006/0045576 | A1* | 3/2006 | Oshika | 399/284 |
| 2008/0131174 | A1* | 6/2008 | Inoue et al. | 399/284 |
| 2009/0016758 | A1* | 1/2009 | Matsuzaki | 399/60 |
| 2009/0297192 | A1* | 12/2009 | Matsuzaki | 399/55 |
| 2009/0324302 | A1* | 12/2009 | Matsumoto | 399/285 |

FOREIGN PATENT DOCUMENTS

| | | | |
|---|---|---|---|
| JP | 2000-283149 | A | 10/2000 |
| JP | 2002-108089 | A | 4/2002 |
| JP | 2006-098825 | A | 4/2006 |
| JP | 2007-256688 | A | 10/2007 |
| JP | 2007-264606 | | 10/2007 |
| JP | 2008-139552 | | 6/2008 |
| WO | WO 2008/075444 | A1 | 6/2008 |

* cited by examiner

*Primary Examiner* — Ryan Walsh
(74) *Attorney, Agent, or Firm* — Rabin & Berdo, P.C.

(57) ABSTRACT

A developer regulating member regulates a thickness of a layer of a developer on a surface of a developer bearing body. The developer has a degree of circularity in a range from 0.94 to 0.97. The developer regulating member includes a resilient plate member composed of a metal material and having a bent portion. An outer surface of the bent portion contacts the surface of the developer bearing body so that a ridge line of the outer surface of the bent portion crosses a moving direction of the surface of the developer bearing body. A curvature radius R (μm) of the outer surface of the bent portion and a mean crystal grain diameter D (μm) of the metal material satisfy the relationship:

$$60\times10^{-3}\times R-11\leqq D\leqq 93.75\times10^{-3}\times R-6.875.$$

18 Claims, 8 Drawing Sheets

FIG.5

| METERIAL CODE | MEAN CRYSTAL GRAIN DIAMETER (μm) | CURVATURE RADIUS (μm) | CHECKING RESULT | | | | | | | | TOTAL EVALUA-TION |
|---|---|---|---|---|---|---|---|---|---|---|---|
| | | | SOLID IMAGE PRINTING | | | | 2×2 IMAGE PRINTING | | | | |
| | | | WHITE VERTICAL BANDS | WHITE VERTICAL STREAKS | COLOR VERTICAL BANDS | COLOR VERTICAL STREAKS | WHITE VERTICAL BANDS | WHITE VERTICAL STREAKS | COLOR VERTICAL BANDS | COLOR VERTICAL STREAKS | |
| SUS304B-TA | 40 | 180 | △ | × | × | × | △ | △ | △ | △ | × |
| SUS304B-TA | 40 | 230 | △ | △ | × | △ | △ | ○ | × | ○ | × |
| SUS304B-TA | 40 | 270 | ○ | ○ | ○ | △ | △ | △ | ○ | ○ | △ |
| SUS304B-TA | 40 | 350 | ○ | ○ | ○ | △ | △ | △ | ○ | ○ | △ |
| SUS304B-TA | 40 | 500 | ○ | ○ | ○ | ○ | △ | ○ | ○ | ○ | ○ |
| SUS304B-TA | 40 | 600 | ○ | ○ | ○ | ○ | ○ | ○ | ○ | ○ | ○ |
| SUS304B-TA | 25 | 600 | ○ | ○ | ○ | ○ | ○ | ○ | △ | ○ | ○ |
| SUS301B-TA | 10 | 180 | ○ | ○ | ○ | △ | ○ | ○ | ○ | ○ | ○ |
| SUS301B-TA | 10 | 200 | ○ | ○ | ○ | ○ | ○ | ○ | ○ | ○ | ○ |
| SUS301B-TA | 10 | 350 | ○ | ○ | ○ | ○ | ○ | ○ | ○ | ○ | ○ |
| SUS301B-TA | 10 | 500 | ○ | ○ | △ | ○ | ○ | ○ | △ | ○ | × |
| SUS301B-TA | 10 | 600 | ○ | ○ | △ | ○ | ○ | ○ | △ | ○ | × |

FIG.7

| METERIAL CODE | MEAN CRYSTAL GRAIN DIAMETER (μm) | CURVATURE RADIUS (μm) | POLISH FINISHING | BLAST FINISHING | ELECTRIC POTENTIAL (−V) | | | ADHESION AMOUNT (mg) | | |
|---|---|---|---|---|---|---|---|---|---|---|
| | | | | | BIAS −120V | BIAS −180V | BIAS −240V | BIAS −120V | BIAS −180V | BIAS −240V |
| SUS304B-TA | 40 | 180 | – | – | 38.4 | 41.4 | 48 | 0.42 | 0.44 | 0.46 |
| SUS304B-TA | 40 | 180 | PERFORM | PERFORM | 41.8 | 45.2 | 50 | 0.49 | 0.44 | 0.48 |
| SUS304B-TA | 40 | 230 | – | – | 41.6 | 45.6 | 48.6 | 0.41 | 0.47 | 0.49 |
| SUS304B-TA | 40 | 230 | PERFORM | PERFORM | 43.2 | 50.2 | 54 | 0.5 | 0.47 | 0.52 |
| SUS304B-TA | 40 | 270 | – | – | 45 | 49.6 | 54.6 | 0.48 | 0.48 | 0.49 |
| SUS304B-TA | 40 | 270 | PERFORM | PERFORM | 48.8 | 53.2 | 60.8 | 0.54 | 0.55 | 0.55 |
| SUS304B-TA | 40 | 350 | – | – | 52.4 | 59.2 | 63 | 0.54 | 0.61 | 0.60 |
| SUS304B-TA | 40 | 350 | PERFORM | PERFORM | 55.4 | 59.4 | 65.2 | 0.57 | 0.54 | 0.59 |
| SUS304B-TA | 40 | 500 | – | – | 58.8 | 66 | 70.8 | 0.6 | 0.62 | 0.68 |
| SUS304B-TA | 40 | 500 | PERFORM | PERFORM | 64.2 | 69.2 | 75.8 | 0.63 | 0.64 | 0.66 |
| SUS301B-TA | 10 | 180 | – | – | 41 | 46.6 | 52 | 0.43 | 0.37 | 0.41 |
| SUS301B-TA | 10 | 180 | PERFORM | PERFORM | 42.6 | 47.4 | 50.4 | 0.41 | 0.47 | 0.46 |

FIG.8

| METERIAL CODE | MEAN CRYSTAL GRAIN DIAMETER (μm) | CURVATURE RADIUS (μm) | CHECKING RESULT | | | | | | | | TOTAL EVALUA-TION |
|---|---|---|---|---|---|---|---|---|---|---|---|
| | | | SOLID IMAGE PRINTING | | | | 2×2 IMAGE PRINTING | | | | |
| | | | WHITE VERTICAL BANDS | WHITE VERTICAL STREAKS | COLOR VERTICAL BANDS | COLOR VERTICAL STREAKS | WHITE VERTICAL BANDS | WHITE VERTICAL STREAKS | COLOR VERTICAL BANDS | COLOR VERTICAL STREAKS | |
| SUS304B-TA | 40 | 180 | △ | × | × | × | △ | △ | △ | △ | × |
| SUS304B-TA | 40 | 230 | △ | △ | △ | △ | △ | ○ | × | ○ | △ |
| SUS304B-TA | 40 | 270 | ○ | ○ | ○ | △ | △ | ○ | ○ | ○ | △ |
| SUS304B-TA | 40 | 300 | ○ | ○ | ○ | ○ | ○ | ○ | ○ | ○ | ○ |
| SUS304B-TA | 40 | 350 | ○ | ○ | ○ | ○ | ○ | ○ | ○ | ○ | ○ |
| SUS304B-TA | 40 | 500 | ○ | ○ | ○ | ○ | ○ | ○ | ○ | ○ | ○ |
| SUS304B-TA | 40 | 600 | ○ | ○ | ○ | ○ | ○ | ○ | ○ | ○ | ○ |
| SUS304B-TA | 25 | 600 | ○ | ○ | ○ | ○ | ○ | ○ | △ | ○ | ○ |
| SUS301B-TA | 10 | 180 | ○ | ○ | ○ | △ | ○ | ○ | ○ | ○ | ○ |
| SUS301B-TA | 10 | 200 | ○ | ○ | ○ | ○ | ○ | ○ | ○ | ○ | ○ |
| SUS301B-TA | 10 | 350 | ○ | ○ | ○ | ○ | ○ | ○ | ○ | ○ | ○ |
| SUS301B-TA | 10 | 500 | ○ | ○ | △ | ○ | ○ | ○ | △ | ○ | × |
| SUS301B-TA | 10 | 600 | ○ | ○ | △ | ○ | ○ | ○ | △ | ○ | × |

DEVELOPER REGULATING MEMBER, DEVELOPING DEVICE, IMAGE FORMING APPARATUS AND MANUFACTURING METHOD OF DEVELOPER REGULATING MEMBER

BACKGROUND OF THE INVENTION

The present invention relates to a developer regulating member for regulating a thickness of a developer layer on a surface of a developer bearing body used in an image forming apparatus such as an electrophotographic printer, copier, facsimile machine or the like. The present invention also relates to a developing device and image forming apparatus using the developer regulating member and a manufacturing method of the developer regulating member.

In a conventional developing device of an image forming apparatus, a blade-shaped developer regulating member is used to regulate a thickness of a developer layer on a surface of a developing roller (i.e., a developer bearing body), as disclosed in Japanese Laid-Open Patent Publication No. 2002-108089 (see Page 3, FIG. 2). Such a developer regulating member is formed of a metal plate member, and has a bent portion. The bent portion of the developer regulating member is brought into contact with the surface of the developing roller so that a ridge line of the outer surface of the bent portion is perpendicular to a moving direction of the surface of the developing roller.

In this regard, there is a demand to enhance a printing quality without increasing a manufacturing cost.

SUMMARY OF THE INVENTION

The present invention is intended to provide a developer regulating member capable of enhancing a printing quality without increasing a manufacturing cost, and to provide a developing device and an image forming apparatus using the developer regulating member and a manufacturing method of the developer regulating member.

The present invention provides a developer regulating member for regulating a thickness of a layer of a developer on a surface of a developer bearing body. The developer has a degree of circularity in a range from 0.94 to 0.97. The developer regulating member includes a resilient plate member composed of a metal material and has a bent portion. An outer surface of the bent portion contacts the surface of the developer bearing body so that a ridge line of the outer surface of the bent portion crosses a moving direction of the surface of the developer bearing body. A curvature radius R (μm) of the outer surface of the bent portion and a mean crystal grain diameter D (μm) of the metal material satisfy the relationship:

$$60\times10^{-3}\times R-11\leqq D\leqq93.75\times10^{-3}\times R-6.875.$$

With such a structure, it becomes possible to suppress generation of wrinkles and cracks at an outer surface of the bent portion of the developer regulating member, and to enhance a printing quality without increasing manufacturing cost.

The present invention also provides a developer regulating member for regulating a thickness of a layer of a developer on a surface of a developer bearing body. The developer has a degree of circularity in a range from 0.98 to 0.99. The developer regulating member includes a resilient plate member composed of a metal material and has a bent portion. An outer surface of the bent portion contacts the surface of the developer bearing body so that a ridge line of the outer surface of the bent portion crosses a moving direction of the surface of the developer bearing body. A curvature radius R (μm) of the outer surface of the bent portion and a mean crystal grain diameter D (μm) of the metal material satisfy the relationship:

$$60\times10^{-3}\times R-11\leqq D\leqq250\times10^{-3}\times R-35.$$

The present invention also provides a developing. device including the above described developer regulating member.

The present invention also provides an image forming apparatus including the above described developing device.

The present invention also provides a manufacturing method of the above described developer regulating member. The method includes a step of forming the plate member by means of a rolling process of the metal material so that a thickness ts of the metal material before the rolling process and a thickness tp of the metal material after the rolling process satisfy the relationship:

$$ts\geqq3\times tp.$$

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 5 is a table showing experimental results of a printing test No. 1 according to the first embodiment;

FIG. 7 is a table showing measurement results of an amount of the toner adhering to the developing blade and an electrical potential of the toner;

FIG. 8 is a table showing experimental results of a printing test No. 2 according to the second embodiment.

DETAILED DESCRIPTION OF THE PREFERRED EMBODIMENT

First Embodiment

Figure 1:
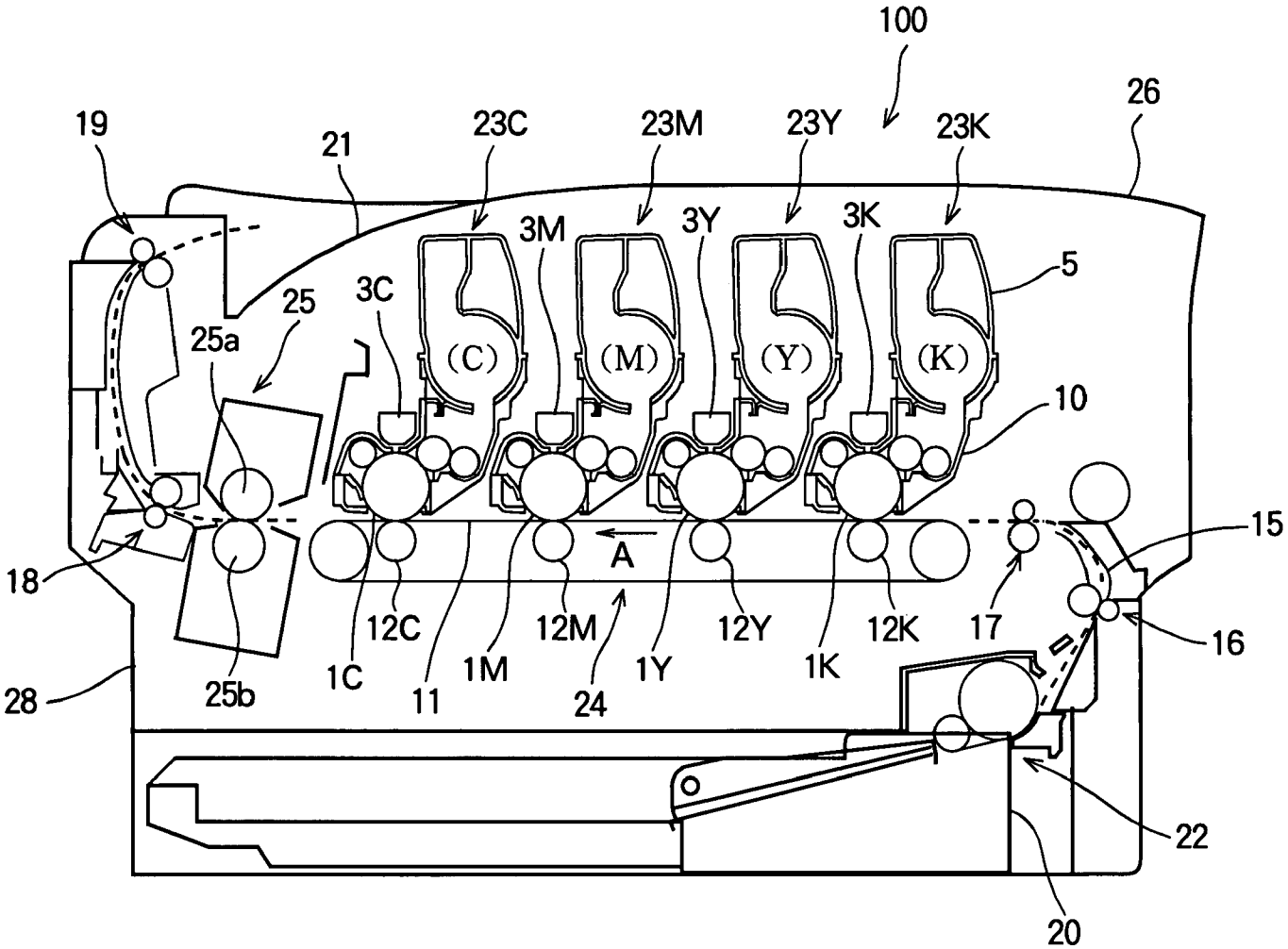
FIG. 1 is a schematic view showing an image forming apparatus including a developing device with a developing blade as a developer regulating member according to the first embodiment of the present invention.

FIG. 1 is a schematic view showing an image forming apparatus including a developing device with a developing blade (i.e., a developer regulating member) according to the first embodiment of the present invention.

In FIG. 1, an image forming apparatus 100 is configured as a color electrophotographic printer capable of printing images of four colors: black (K), yellow (Y), magenta (M) and cyan (C). The image forming apparatus 100 includes a lower frame 28 and an upper frame 26 that constitute a main body. Sheet feeding roller pairs 16, 17, 18 and 19 are disposed in the lower frame 2.8 so as to form a substantially S-shaped sheet feeding path 15 (including sections indicated by dashed lines in FIG. 1). A sheet cassette 20 for storing recording sheets (i.e., recording media) is disposed in a lower part of the lower frame 28, which defines an uppermost end of the sheet feeding path 15. A stacker 21 is disposed on the upper frame 26, which defines a downstream end of the sheet feeding path 15.

Along the sheet feeding path 15, a sheet supplying portion 22, a conveying belt unit 24 and a fixing portion unit 25 are disposed. The sheet supplying portion 22 is configured to feed the individual recording sheets out of the sheet cassette 20. The sheet feeding roller pairs 16 and 17 are disposed on the downstream side of the sheet supplying portion 22, and feed the recording sheets having been fed out of the sheet cassette 20. The conveying belt unit 24 includes a transfer belt 11 that electrostatically absorbs and conveys the recording sheet having been fed by the sheet feeding roller pairs 16 and 17. The fixing unit 25 is configured to fix a toner image (i.e., a developer image) to the recording sheet.

Further, developing units 23K, 23Y, 23M and 23C are disposed so as to face the conveying belt unit 24 via the recording sheet conveyed by the transfer belt 11. The developing units 23K, 23Y, 23M and 23C (collectively referred to as developing units 23) are linearly arranged in this order from the upstream to the downstream along the sheet feeding path 15, and contain toners as developers of Black (K), Yellow (Y), Magenta (M) and Cyan (C). The developing units 23K, 23Y, 23M and 23C are detachably mounted on the main body of the image forming apparatus 100.

Next, configurations of the developing units 23K, 23Y, 23M and 23C will be described. Since the developing units 23K, 23Y, 23M and 23C have the same configurations except the toners, the developing units 23K, 23Y, 23M and 23C are collectively referred to as a developing unit 23 in the description below.

Figure 2:
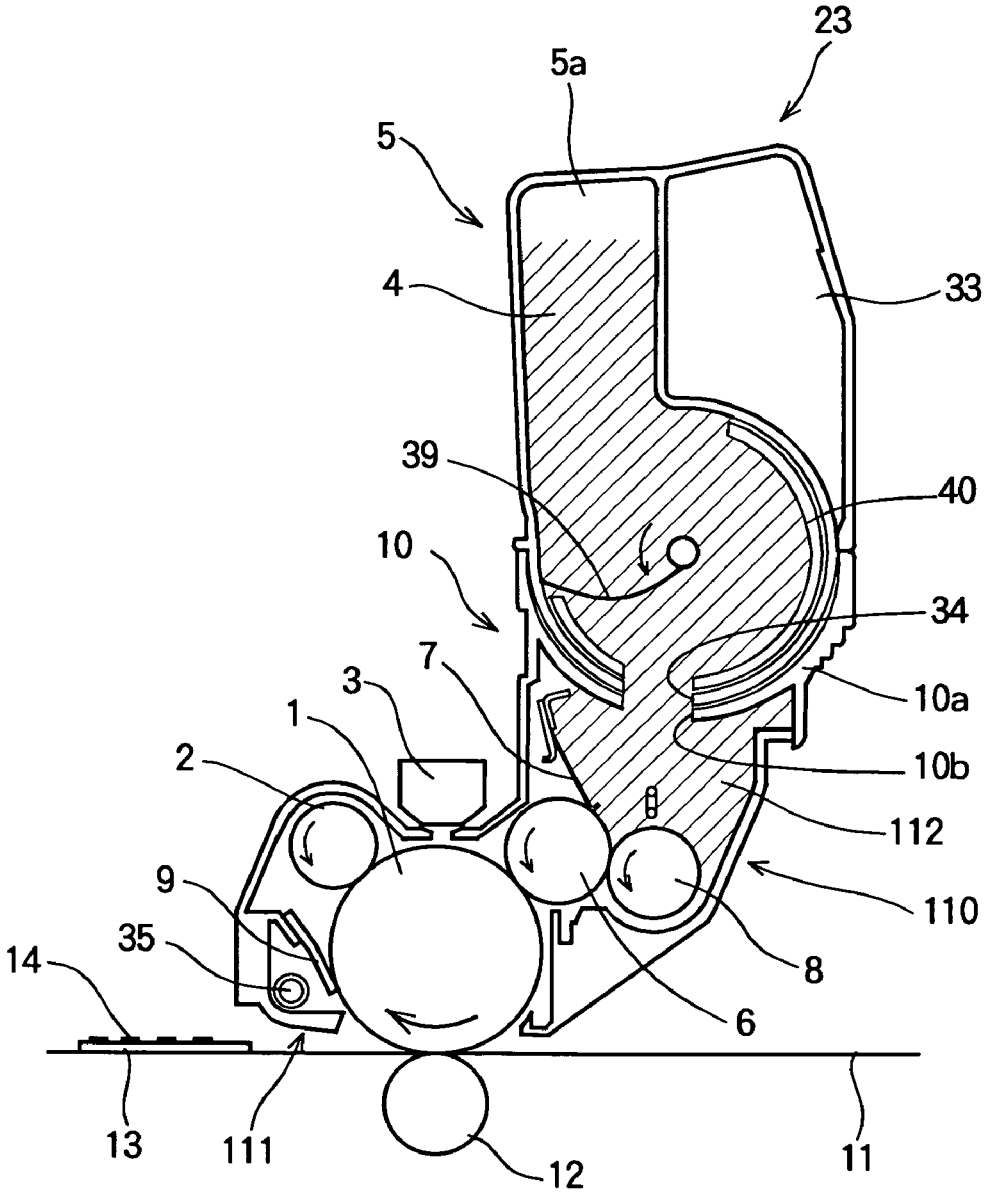
FIG. 2 is a schematic view showing a developing device according to the first embodiment of the present invention together with a transfer roller, an exposure device and a recording medium.

FIG. 2 shows a schematic sectional view showing the developing unit 23 together with a transfer roller 12, an exposure device 3 and a recording sheet 13.

As shown in FIG. 2, the developing unit 23 includes a photosensitive body 1 in the form of a drum rotatable in a direction shown by an arrow in FIG. 2. The photosensitive body 1 is chargeable with electrical charge at a surface thereof, and the electrical charge can be removed by exposure. A charging roller 2 and an exposure device 3 are disposed along a circumference of the photosensitive body 1. The charging roller 2 is pressed against the photosensitive body 1 and rotates in a direction indicated by an arrow so as to uniformly charge the surface of the photosensitive body 1. The exposure device 3 includes a light source such as an LED head, and exposes the charged surface of the photosensitive body 1 so as to form a latent image on the surface of the photosensitive body 1. The exposure device 3 is mounted to the upper frame 26 of the main body of the image forming apparatus 100 (FIG. 1).

Further, a developing portion 110 as a developing device and a cleaning blade 9 are disposed along the circumference of the photosensitive body 1. The developing portion 110 develops the latent image on the surface of the photosensitive body 1 using the toner of a predetermined color so as to form a toner image. The cleaning blade 9 removes a residual toner that remains on the surface of the photosensitive body 1 after the toner image is transferred to the recording sheet 13. The toner removed by the cleaning blade 9 falls into a waste toner collecting portion 111. The cleaning blade 9 is composed of a resilient blade, and is disposed so that an edge portion of the cleaning blade 9 is pressed against the surface of the photosensitive body 1 with a constant pressure. A waste toner conveying member 35 is disposed in the waste toner collecting portion 111. The waste toner conveying member 35 is composed of a spiral or a coil spring, and conveys a waste toner (i.e., the toner having been fallen from the photosensitive body 1) in a predetermined direction. Rotating bodies such as the rollers and the drum are rotated by powers transmitted by a driving source (not shown) via gears.

The developing portion 110 includes a toner cartridge 5, a toner storing chamber 112, a developing roller 6, a toner supplying roller 8 and a developing blade 7. The toner cartridge 5 stores a fresh toner 4 therein, and supplies the toner 4 via a toner supplying opening 34 (i.e., a developer supplying opening) having an elongated shape along a longitudinal direction of the toner cartridge 5. The toner storing chamber 112 stores the toner 4 supplied by the toner cartridge 5. The developing roller 6 as a developer bearing body is disposed contacting the surface of the photosensitive body 1. The toner supplying roller 8 as a developer supplying member is configured to supply the toner to the developing roller 6. The developing blade 7 is configured to regulate a thickness of a layer of the toner 4 (i.e., a toner layer) on the surface of the developing roller 6. The developing portion 110 causes the toner to adhere to the latent image on the surface of the photosensitive body 1 using the toner 4, so as to develop (i.e., visualize) the latent image. The developing roller 6, the toner supplying roller 8 and the developing blade 7 are applied with respective bias voltages by a developing roller power source, a supplying roller power source and a developing blade power source.

The toner cartridge 5 is detachably mounted to a part of the developing unit 23 above the toner supplying roller 8. A part of the developing unit 23 except the toner cartridge 5 is referred to as a developing unit main body. The developing unit main body is enclosed by a housing 10 with a cover frame 10*a* onto which the toner cartridge 5 is placed for supplying the toner 4 to the toner storing chamber 112. The cover frame 10*a* has a toner replenishing opening 10*b* so as to face the toner supplying opening 34 of the toner cartridge 5. The toner is supplied from the toner cartridge 5 to the toner storing chamber 112 via the toner supplying opening 34 and the toner replenishing opening 10*b*.

The developing roller 6 and the toner supplying roller 8 are disposed parallel to each other, and are pressed against each other with a constant pressure. The toner 4 is supplied by the toner supplying roller 8 to the developing roller 6 due to a supplying bias voltage applied by the supplying roller power source (not shown). The developing blade 7 and the developing roller 6 are disposed parallel to each other so that a bent portion 7*a* (FIG. 3) of the developing blade 7 is pressed against the circumferential surface of the developing roller 6 with a constant pressure. The developing roller 6 applied with a developing bias voltage is pressed against the surface of the photosensitive body 1 with a constant pressure, and develops the latent image (having been formed by the exposure device 3) using the toner 4 of the thin toner layer formed by the developing blade 7. The developing blade 7 will be described later.

As shown in FIG. 1, the transfer rollers 12 composed of electrically-conductive rubbers or the like are disposed so as to face the respective photosensitive bodies 1 of the four developing units 23 (23K, 23Y, 23M and 23C). The transfer rollers 12 are pressed against the photosensitive bodies 1 via the transfer belt 11 that electrostatically absorbs and feeds the recording sheet 13 (FIG. 2). The transfer roller 12 is applied with the transfer bias voltage so as to generate an electrical potential difference between the transfer roller 12 and the photosensitive body 1 when the transfer roller 12 transfers the toner image from the photosensitive body 1 to the recording sheet 13.

The fixing unit 25 (FIG. 1) includes a heat roller 25*a* and a backup roller 25*b* that heat and pressurize the recording sheet 13 (FIG. 2) on which the toner images of the respective colors have been transferred by four pairs of the developing units 23 and the transfer rollers 21. Due to heat and pressure applied by the heat roller 25*a* and the backup roller 25*b*, the toner image is fixed to the recording sheet 13. The sheet feeding roller pairs 18 and 19 are disposed on the downstream side of the fixing unit 25, and eject the recording sheet 13 (to which the toner image is fixed by the fixing unit 25) to the stacker portion 21.

As shown in FIG. 2, the toner cartridge 5 includes a toner storing portion 5*a* for storing a fresh toner 4 and a waste toner storing portion 5*b* for storing a waste toner having been collected by the waste toner collecting portion 111 and conveyed by a not shown waste toner conveying mechanism. A toner agitating member 39 is provided in the toner storing portion 5*a*. The toner agitating member 39 rotates in a direction indicated by an arrow so as to agitate the toner 4 and convey the toner 4 toward the toner supplying opening 34. The toner supplying opening 34 is opened and closed by a shutter 40 rotatably provided inside the toner storing portion 5*a* as necessary.

Next, a description will be made of the developing blade 7, as well as a relationship between the developing blade 7 and the developing roller 6.

Figure 3:
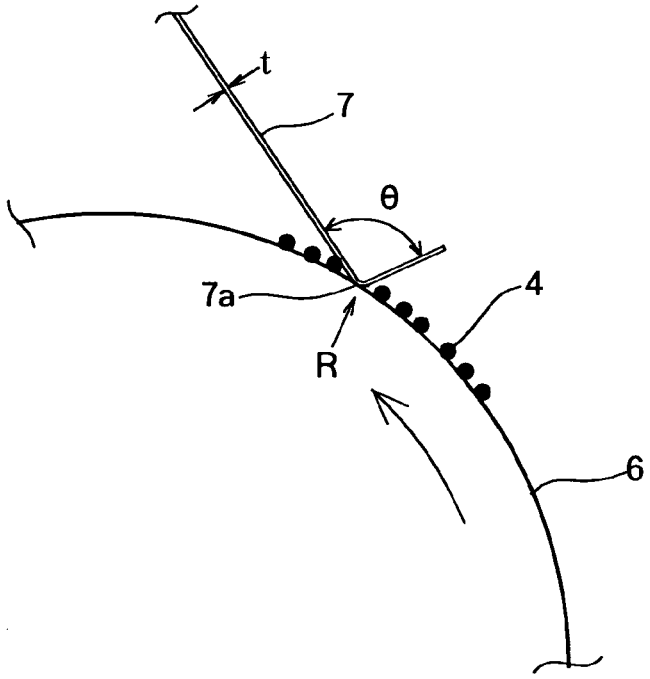
FIG. 3 is a schematic view showing a vicinity of a contact portion between a developing roller and the developing blade according to the first embodiment of the present invention.

FIG. 3 is an enlarged view schematically showing the vicinity of the contact portion between the developing roller 6 and the developing blade 7.

As shown in FIG. 3, the developing blade 7 (i.e., a developer regulating member) is disposed in parallel to the developing roller 6 so that the bent portion 7*a* of the developing blade 7 is pressed against the circumferential surface of the developing roller 6 with a constant pressure. If a contact pressure between the developing blade 7 and the developing roller 6 is too low, the thickness of the toner layer on the surface of the developing roller 6 can not be sufficiently regulated. In such a case, the thickness of the toner layer becomes nonuniform, with the result that stains or streaks may appear on the printed image. In contrast, if the contact pressure is too high, the toner 4 may be clogged between the developing blade 7 and the developing roller 6. In such a case, the toner 4 is not sufficiently carried through between the developing blade 7 and the developing roller 6, with the result that image defects may appear on the printed image. For these reasons, in order to suitably regulate the thickness of the toner layer, the developing blade 7 is pressed against the developing roller 6 with a linear pressure in a range from 10 to 50 N/m.

The developing blade 7 is composed of a metal material. In this example, the developing blade 7 is made of a metal spring whose material code is SUS301B-TA (subject to Tension-Annealing treatment), and has a thickness tp of 0.08 mm. The developing blade 7 is bent at an angle θ, and an outer surface of the bent portion 7*a* has a curvature radius R. The developing blade 7 contacts the developing roller 6 with a constant pressure (which is constant in the longitudinal direction of the developing roller 6) in such a manner that a ridge line of the outer surface of the bent portion 7*a* extends crossing (more specifically, perpendicular to) a moving direction of the surface of the developing roller 6.

For example, the developing blade 7 (composed of material whose material code is SUS301B-TA) has a ten-point mean surface roughness Rz in a range from 1 to 2 μm and an arithmetic mean surface roughness Ra in a range from 0.1 to 0.3 μm. Since the outer surface of the bent portion 7*a* of the developing blade 7 has a smooth surface (with a low surface roughness), the adhesion of the toner to the outer surface of the bent portion 7*a* can be suppressed by setting the curvature radius R of the outer surface of the bent portion 7*a* in a suitable range, and it is not necessary to perform polishing or blast finishing as described later.

The developing roller 6 has an outer resilient layer having a ten-point mean surface roughness Rz in a range from 2 to 10 μm and an arithmetic mean surface roughness Ra in a range from 0.4 to 1.4 μm. The resilient layer has an ASKER-C hardness in a range from 65° to 85°.

The toner 4 preferably has a degree of circularity in a range from 0.94 to 0.99. That is, it is preferable that toner particles of the toner 4 have substantially spherical particle shapes.

Here, a description will be made of movement of the toner 4 in the vicinity of the contact portion between the developing roller 6 and the developing blade 7. The toner 4 adheres to the surface of the developing roller 6 due to a contact pressure between the toner supplying roller 8 and the developing roller 6, a difference between circumferential speeds of the toner supplying roller 8 and the developing roller 6, and bias voltages applied to the toner supplying roller 8 and the developing roller 6. The toner 4 on the surface of the developing roller 6 is carried to the contact portion between the developing roller 6 and the developing blade 7. The outer surface of the bent portion 7*a* of the developing blade 7 contacts the developing roller 6 with a suitable linear pressure in a range from 10 to 50 N/m, with the result that the toner 4 having passed through the contact portion between the developing roller 6 and the developing blade 7 forms a thin toner layer having a regulated thickness.

In general, the developing blade 7 is a plate member composed of a metal material, and therefore wrinkles or cracks may be formed on the outer surface of the bent portion 7*a* which is stretched in a bending process. In such a case, the toner 4 may adhere to the wrinkles and cracks on the outer surface of the bent portion 7*a* of the developing blade 7. The toner 4 adhering to the wrinkles and cracks on the outer surface of the bent portion 7*a* of the developing blade 7 may affect the formation of the toner layer on the developing roller 6, so that vertical streaks or bands may appear on the printed image. The wrinkles and cracks of the outer surface of bent portion 7*a* of the developing blade 7 can generally be removed by polishing and blast finishing.

However, according to the first embodiment, a mean crystal grain diameter D of the metal material of the developing blade 7 and the curvature radius R of the bent portion 7*a* of the developing blade 7 are so set that the wrinkles and cracks are not formed the outer surface of the bent portion 7*a* of the developing blade 7, and therefore it is not necessary to perform polishing and blast finishing. Such a developing blade 7 of the first embodiment will be described below.

First, a description will be made of a printing test No. 1 using a plurality of developing blades 7 (i.e., test pieces) having different mean crystal grain diameters D and different curvature radii R.

The printing test No. 1 was performed under the following conditions:

(1) The toners of the respective colors were used. The degree of circularity of the toner was in a range from 0.94 to 0.97.

(2) The image forming apparatus 100 was used as a testing machine.

(3) Two kinds of metal materials SUS304B-TA and SUS301B-TA having different mean crystal grain diameters D (respectively 40 μm and 10 μm) were used. In addition, the metal material SUS304B-TA having mean crystal grain diameter D of 25 μm was also used. These metal materials were respectively formed into plates each having the thickness (tp) of 80 μm by rolling and cooling, and were bent at bending angles (θ) of 90°.

(4) A linear pressure between each test piece (i.e., the developing blade 7) and the developing roller 7 was set to 29.4 N/m.

(5) The developing rollers 4 having ten-point mean surface roughness Rz in a range from 2 to 10 μm and arithmetic mean surface roughness Ra in a range from 0.4 to 1.4 μm and having ASKER-C hardness (rubber hardness) in a range from 70° to 85° were used.

(6) Printings were carried out under environments of RT (temperature of approximately 24° C. and humidity of approximately 45%), HH (temperature of approximately 27° C. and humidity of approximately 80%) and LL (temperature of approximately 10° C. and humidity of approximately 20%).

(7) Whole-surface solid images (at image densities of 100%) were printed on approximately 12000 A4-standard sheets (4000 sheets for each of the environments RT, HH and LL), and then 2×2 patterns (at image densities of 25%) were printed on approximately 12000 A4-standard sheets (4000 sheets for each of the environments RT, HH and LL).

Figure 4:
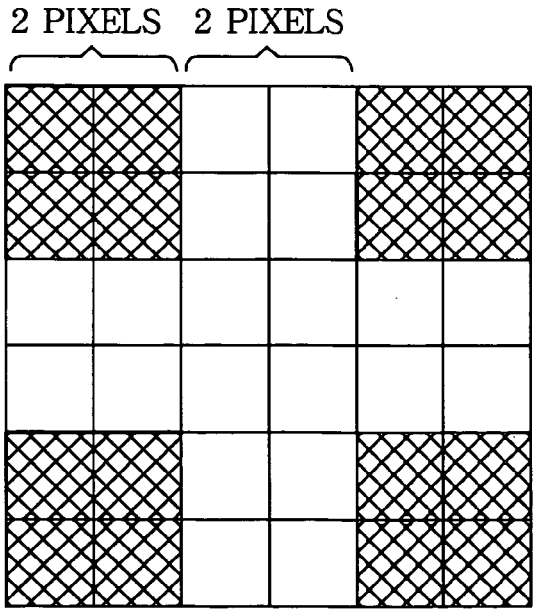
FIG. 4 shows a 2×2 pattern used in a printing test No. 1 according to the first embodiment.

As shown in FIG. 4, the 2×2 pattern includes a plurality of segments arranged in a matrix, and each segment includes four pixels (two pixels are arranged in each of vertical and horizontal directions). Further, respective segments are spaced from each other by two pixels in each of the vertical and horizontal directions.

Thereafter, the printed 2×2 patterns were observed to check whether white/color vertical streaks (narrower than 2 mm) and white/color vertical bands (wider than or equal to 2 mm) appear thereon.

The white vertical streaks and white vertical bands are white portions with no toner (in the form of streaks or bands) that appear on the segments of the 2×2 patterns. The colored vertical streaks and colored vertical bands are colored portions (in the form of streaks or bands) that appear on the spaces of the 2×2 patterns.

FIG. 5 shows experimental results of the printing test No. 1.

In FIG. 5, checking results of vertical streaks and vertical bands are expressed using marks "O", "Δ" and "X".

The mark "O" (excellent) indicates that no streak or no band is observed.

The mark "Δ" (good) indicates that streaks and/or bands are observed, but the streaks and/or bands are at allowable level as compared with a reference sample.

The mark "X" (poor) indicates that streaks and/or bands are observed, and the streaks and/or bands are beyond allowable level as compared with a reference sample.

Based on the above described checking results (O, Δ and X), total evaluation results are determined. The total evaluation results are expressed using marks "O", "Δ" and "X".

The total evaluation result is "O" (excellent) when the number of the checking results "Δ" is 1 or 0 and the number of the checking results "X" is zero.

The total evaluation result is "Δ" (good) when the number of the checking results "Δ" is 2 or more and the number of the checking results "X" is zero.

The total evaluation result is "X" (poor) when the number of the checking results "X" is 1 or more.

Here, the total evaluation result is determined to be "Δ" (i.e., not "O") when the number of the checking results "Δ" is two or more, although the checking results "Δ" indicates that streaks and/or bands at the allowable level.

The checking results and the total evaluation results shown in FIG. 5 lead to the following conclusions.

(1) When the mean crystal grain diameter D is 40 μm, the curvature radius R is preferably in the following range: R≧500 μm.

(2) When the mean crystal grain diameter D is 10 μm, the curvature radius R is preferably in the following range: 350 μm≧R≧180 μm.

Further, if the curvature radius R is too large, a peak pressure between the developing blade 7 and the developing roller 6 may decrease, and therefore the developing blade 7 needs to be pressed against the developing roller 6 with a high pressure, which is not suitable for practical use. Therefore, the curvature radius R of the developing blade 7 is preferably in the following range: 180 μm≦R≦600 μm.

In this regard, the preferable ranges of the mean crystal grain diameter D and the curvature radius R corresponding to the ranges providing the total evaluation results "O" (excellent) in FIG. 5.

Figure 6:
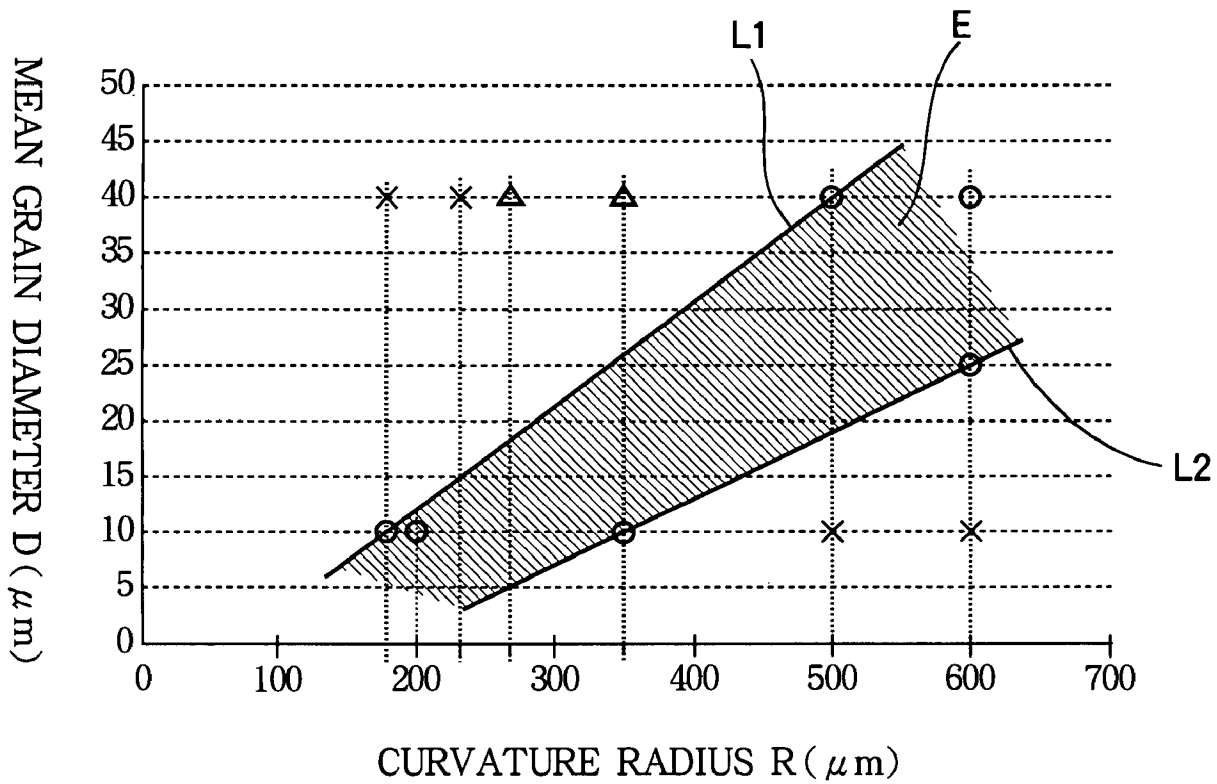
FIG. 6 is a graph showing a relationship between a mean crystal grain diameter D and a curvature radius R as well as experimental results of the printing test No. 1 according to the first embodiment.

FIG. 6 is a graph showing a relationship between the mean crystal grain diameter D and the curvature radius R, as well as the total evaluation results of the printing test No. 1 (shown in FIG. 5).

In FIG. 6, when the developing blade 7 has the mean crystal grain diameter D of 40 μm, the total evaluation results "O" is obtained when the curvature radius R is 500 μm or more. When the developing blade 7 has the mean crystal grain diameter D of 10 μm, the total evaluation results of "O" is obtained when the curvature radius R is in a range from 180 to 350 μm. There is a range of the curvature radius R providing the total evaluation results "O" (excellent) for respective mean crystal grain diameters D, as shown by a hatched area (referred to as an excellent printing area E) in FIG. 6. As the mean crystal grain diameter D increases, the excellent printing area E shifts in a direction in which the curvature radius R increases.

In FIG. 6, a line L1 defines a lower limit of the curvature radius R providing the total evaluation results "O" (excellent) for respective mean crystal grain diameters D. To be more specific, the line L1 passes a coordinate point (500 μm, 40 μm) and another coordinate point (180 μm, 10 μm). A line L2 defines an upper limit of the curvature radius R providing the total evaluation results "O" (excellent) for respective mean crystal grain diameters D. To be more specific, the line L2 passes a coordinate point (600 μm, 25 μm) and another coordinate point (350 μm, 10 μm).

From the coordinate points with the line L1 passes, the line L1 is expressed as follows:

$$D=93.75\times10^{-3}\times R-6.875$$

Similarly, the line L2 is expressed as follows:

$$D=60\times10^{-3}\times R-11$$

Therefore, the preferable ranges of the mean crystal grain diameter D (μm) and the curvature radius R (μm) of the developing blade 7 are expressed as follows:

$$60\times10^{-3}\times R-11\leqq D\leqq93.75\times10^{-3}\times R-6.875 \quad (1)$$

As described above, in the case where the toner has the degree of circularity in a range from 0.94 to 0.97, generation of wrinkles and cracks on the outer surface of the bent portion 7*a* of the developing blade 7 can be prevented by setting the mean crystal grain diameter D (μm) and the curvature radius R (μm) so as to satisfy the inequality (1). Therefore, the adhesion of the toner to the wrinkles and cracks on the outer surface of the bent portion 7*a* of the developing blade 7 can be prevented. As a result, images with no vertical streaks or bands can be formed on the recording sheet, and therefore a printing quality can be enhanced.

Further, through experiments, the inventors found that a stable mean crystal grain diameter D is obtained when the developing blade 7 is formed of a metal material by a rolling process in such a manner that a thickness ts of the metal material before the rolling process and a thickness tp of the metal material after the rolling process satisfy the relationship:

$$ts \geqq 3 \times tp.$$

The reason is considered to be as follows. As the thickness of the metal material before the rolling process becomes thicker relative to the thickness (i.e., final thickness) of the metal material after the rolling process, a rolling reduction rate becomes larger, and therefore texture of material becomes finer through an annealing process.

Next, a description will be made of measurement results of the amount (mg) of the toner adhering to the developing blade 7 and the electrical potential (−V) of the toner.

In this test, the developing blades 7 having different mean crystal grain diameters D and different curvature radii R were prepared as test pieces. Two types of the developing blades 7 having the same grain diameters D and the same curvature radii R were prepared: the developing blades 7 of a first type had the bent portions 7*a* which were polished and blast-finished, and the developing blades 7 of a second type had the bent portions 7*a* which were not polished or blast-finished. Bias voltages applied to these developing blades 7 were varied in three levels, −120V, −180V and −240V. Under these conditions, electric potentials (−V) of the developing blades 7 were measured. Further, amounts (mg) of the toners adhering to the outer surfaces of the bent portions 7*a* of the developing blades 7 were measured.

The experimental results are shown in FIG. 7.

From FIG. 8, for the same mean crystal grain diameter D, both of the absolute value of the electric potential (−V) and the amount of the toner adhering to the developing blade 7 increase as the curvature radius R increases. Further, for the same curvature radii R (as well as the mean crystal grain diameter D), both of the absolute value of the electric potential (−V) and the amount of the toner adhering to the developing blade 7 increase by performing polishing and blast finishing.

In addition, through experiments, the inventors have found that the electric potential of the toner whose absolute value is less than |−40V| causes insufficient toner supply and therefore a printing density becomes too thin. Further, the inventors have found that the electric potential of the toner whose absolute value is greater than |−70V| causes excessive toner supply and therefore a printed image tends to smear. Furthermore, the inventors have found that the increase in the curvature radius causes increase in the electric potential of the toner, and it becomes difficult to control the image forming process.

According to the experimental results shown in FIG. 7, the metal materials with various mean crystal grain diameters D are usable according to conditions. In this regard, as the mean crystal grain diameter D becomes smaller, it becomes possible to use the developing blade 7 with the bent portion 7*a* whose outer surface has a smaller curvature radius R. Therefore, when the metal material SUS304B-TA having the mean crystal grain diameter D of approximately 40 μm and the metal material SUS301B-TA having the mean crystal grain diameter D of approximately 10 μm are compared with each other, it is preferred to use the metal material SUS301B-TA having the mean crystal grain diameter D of approximately 10 μm.

Advantages of the first embodiment will be herein described.

Generally, when a metal plate member is bent at a predetermined angle, cracks or wrinkles may be generated at an outer surface of the bent portion. In such a case, the toner on the surface of the developing roller tends to adhere to the outer surface of the bent portion of the developing blade, so that vertical bands or streaks may appear on a printed image. The wrinkles or cracks on the bent portion need to be removed by polishing and blast finishing, which may increase a manufacturing cost and make a manufacturing control unstable.

In contrast, according to the first embodiment of the present invention, when the toner has the degree of circularity in a range from 0.94 to 0.97, the mean crystal grain diameter D (μm) and the curvature radius R (μm) of the bent portion 7*a* of the developing blade 7 as so set as to satisfy the above described inequality (1). With such a configuration, generation of wrinkles and cracks on the outer surface of the bent portion 7*a* of the developing blade 7 can be suppressed, and adhesion of the toner to the wrinkles and cracks on the outer surface of the bent portion 7*a* of the developing blade 7 can be prevented. As a result, images with no vertical streaks or bands can be printed, and a printing quality can be enhanced.

Further, since generation of wrinkles and cracks on the bent portion 7*a* of the developing blade 7 can be prevented, it is not necessary to perform polishing or blast finishing. Therefore, a manufacturing cost can be reduced, and a stabilized manufacturing control can be maintained.

Second Embodiment

The second embodiment of the present invention is based on a printing test No. 2 using the toner having a degree of circularity in a range from 0.98 to 0.99.

The printing test No. 2 was performed under the same conditions as the printing test No. 1 described in the first embodiment except using the toner having the degree of circularity in a range from 0.98 to 0.99. Therefore, duplicate explanations will be omitted, and differences will be described below.

The printing test No. 2 was performed using a plurality of developing blades 7 having different mean crystal grain diameters D and different curvature radii R and using the toner having the degree of circularity in a range from 0.98 to 0.99. The conditions of the printing test No. 2 are the same as those of the printing test No. 1 described in the first embodiment (i.e., the conditions (2) through (7)) except using the toner having the degree of circularity in a range from 0.98 to 0.99.

FIG. 8 shows experimental results of the printing test No. 2.

The checking results and the total evaluation results shown in FIG. 8 lead to the following conclusions.

(1) When the mean crystal grain diameter D is 40 μm, the curvature radius R is preferably in the following range: R≧300 μm.

(2) When the mean crystal grain diameter D is 10 μm, the curvature radius R is preferably in the following range: 350 μm≦R≦180 μm.

Further, when the curvature radius R becomes too large, a peak pressure between the developing blade 7 and the developing roller 6 may decrease, and therefore the developing blade 7 needs to be pressed against the developing roller 6 with a high pressure, which is not suitable for practical use. Therefore, the curvature radius R of the developing blade 7 is preferably in the following range: 180 μm≦R≦600 μm.

In this regard, the preferable ranges of the mean crystal grain diameter D and the curvature radius R provide the total evaluation results "O" (excellent) in FIG. 8.

Figure 9:
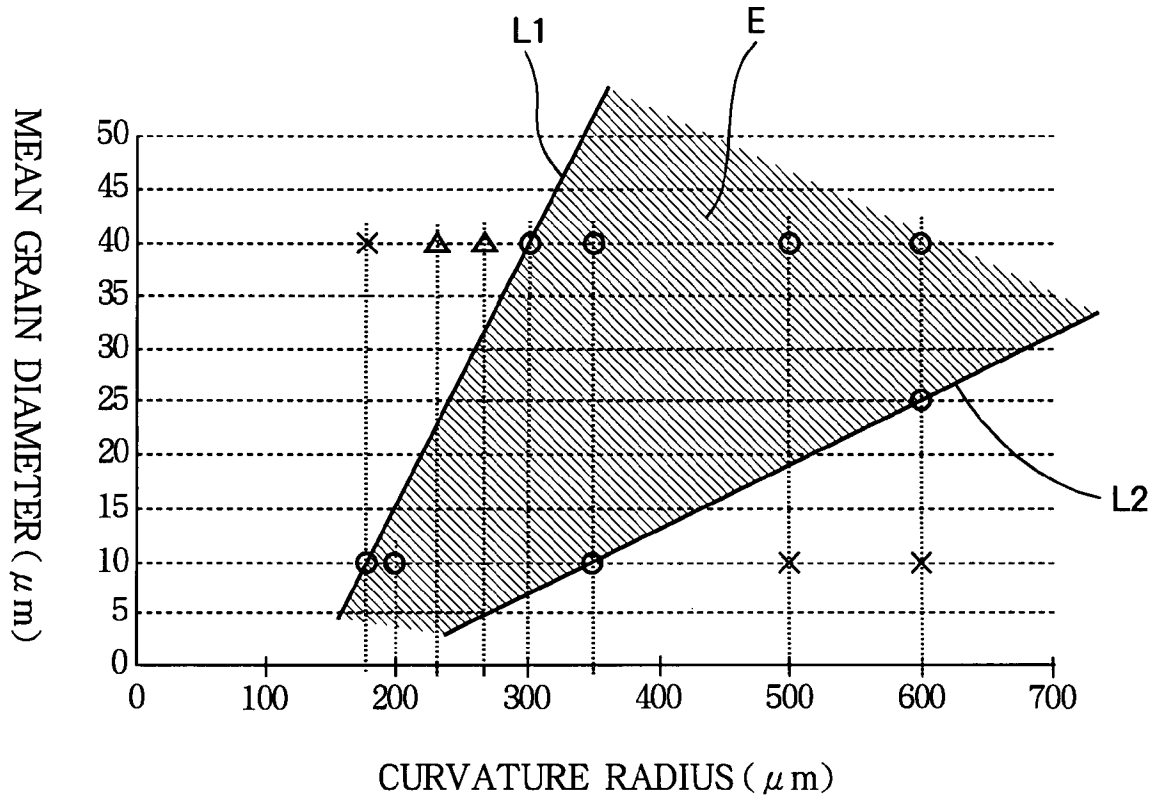
FIG. 9 is a graph showing a relationship between a mean crystal grain diameter D and a curvature radius R as well as experimental results of the printing test 2 according to the second embodiment.

FIG. 9 is a graph showing a relationship between the mean crystal grain diameter D and the curvature radius R, as well as the total evaluation results of the printing test No. 2 (shown in FIG. 8).

In FIG. 9, when the developing blade 7 has the mean crystal grain diameter D of 40 μm, the total evaluation results "O" is obtained when the curvature radius R is 300 μm or more. Further, when the developing blade 7 has the. mean crystal grain diameter D of 10 μm, the total evaluation results of "O" is obtained when the curvature radius R is in a range from 180 to 350 μm. As the mean crystal grain diameter D increases, the area (i.e., the excellent printing area E) in which the total evaluation results "O" are obtained shifts in a direction in which the curvature radius R increases.

In FIG. 9, a line L1 defines a lower limit of the curvature radius R providing the evaluation results "O" for respective mean crystal grain diameters D. To be more specific, the line L1 passes a coordinate point, (300 μm, 40 μm) and another coordinate point (180 μm, 10 μm). A line L2 defines an upper limit of the curvature radius R providing the evaluation results "O" for respective mean crystal grain diameters D. To be more specific, the line L2 passes a coordinate point (600 μm, 25 μm) and another coordinate point (350 μm, 10 μm).

From the coordinate points that the line L1 passes, the line L1 is expressed as follows:

$$D=250\times10^{-3}\times R-35$$

Similarly, the line L2 is expressed as follows:

$$D=60\times10^{-3}\times R-11$$

Therefore, the preferable ranges of the mean crystal grain diameter D (μm) and the curvature radius R (μm) of the developing blade 7 are expressed as follows:

$$60\times10^{-3}\times R-11\leqq D\leqq250\times10^{-3}\times R-35 \quad (2)$$

As described above, in the case where the toner has the degree of circularity in a range from 0.98 to 0.99, generation of wrinkles and cracks on the outer surface of the bent portion 7*a* of the developing blade 7 can be suppressed by setting the mean crystal grain diameter D (μm) and the curvature radius R (μm) so as to satisfy the inequality (2). Therefore, the adhesion of the toner to the wrinkles and cracks on the outer surface of the bent portion of the developing blade 7 can be prevented. As a result, images with no vertical streaks or bands can be printed, and a printing quality can be enhanced.

Further, it is understood that, when the mean crystal grain diameter D is greater than or equal to 10 μm, the excellent printing area E when using the toner having the degree of circularity in a range from 0.94 to 0.97 (FIG. 6) is included in the excellent printing area E when using the toner having the degree of circularity in a range from 0.98 to 0.99 (FIG. 8).

Through experiments, the inventors found that a stable mean crystal grain diameter of the developing blade 7 is obtained when the developing blade 7 is formed of a metal plate by a rolling process in such a manner that a thickness ts of the metal material before the rolling process and a thickness tp of the metal material after the rolling process satisfy the relationship:

$$ts\geqq3\times tp.$$

As described above, according to the second embodiment of the present invention, when the toner has the degree of circularity in a range from 0.98 to 0.99, the mean crystal grain diameter D (μm) and the curvature radius R (μm) of the bent portion 7*a* of the developing blade 7 are so set as to satisfy the above described inequality (2). With such a configuration, generation of wrinkles and cracks on the outer surface of the bent portion 7*a* of the developing blade 7 can be suppressed, and adhesion of the toner to the wrinkles and cracks on the outer surface of the bent portion 7*a* of the developing blade 7 can be prevented. As a result, the vertical streaks and bands on the printed image can be suppressed, and the printing quality can be enhanced.

Further, since generation of wrinkles and cracks on the bent portion 7*a* of the developing blade 7 can be prevented, it is not necessary to perform polishing or blast finishing. Therefore, a manufacturing cost can be reduced, and a stabilized manufacturing control can be maintained.

While the preferred embodiments of the present invention have been illustrated in detail, it should be apparent that modifications and improvements may be made to the invention without departing from the spirit and scope of the invention as described in the following claims.

What is claimed is:

1. A developing device comprising:

a developer bearing body that bears a developer; and a developer regulating member that regulates a thickness of a layer of a developer having a degree of circularity in a range from 0.94 to 0.97 on a surface of said developer bearing body, said developer regulating member comprising a resilient plate member composed of a metal material and having a bent portion;

wherein an outer surface of said bent portion contacts said surface of said developer bearing body so that a ridge line of said outer surface of said bent portion crosses a moving direction of said surface of said developer bearing body;

wherein a curvature radius R (μm) of said outer surface of said bent portion and a mean crystal grain diameter D (μm) of said metal material satisfy the relationship:

$$60\times10^{-3}\times R-11\leqq D\leqq93.75\times10^{-3}\times R-6.875;\text{ and}$$

wherein said developer bearing body is a roller having a resilient outer layer, and said resilient outer layer has an ASKER-C hardness in a range from 65° to 85°.

2. The developing device according to claim 1, wherein said mean crystal grain diameter D is greater than or equal to 10 μm.

3. The developing device according to claim 1, wherein said outer surface of said bent portion has an arithmetic mean surface roughness Ra in a range from 0.1 μm to 0.3 μm.

4. The developing device according to claim 1, wherein said resilient outer layer has ten-point surface roughness in a range from 2 to 10 μm and arithmetic mean roughness in a range from 0.4 to 1.4 μm.

5. The developing device according to claim 4, wherein said developer regulating member is urged against said developer bearing body with a linear pressure in a range from 10 to 50 N/m.

6. The developing device according to claim 1, further comprising a latent image bearing body that bears a latent image to be developed by said developer bearing body.

7. An image forming apparatus comprising said developing device according to claim 6.

8. The developing device according to claim 1, wherein said curvature radius R is in the following range: 180 μm<R≦600 μm.

9. The developing device according to claim 8, wherein said mean crystal grain diameter D is in the following range: 10 μm≦D≦40 μm.

10. A developer regulating member that regulates a thickness of a layer of a developer having a degree of circularity in a range from 0.98 to 0.99 on a surface of a developer bearing body, the developer regulating member comprising:

a resilient plate member composed of a metal material and having a bent portion;

wherein an outer surface of said bent portion contacts said surface of said developer bearing body so that a ridge line of said outer surface of said bent portion crosses a moving direction of said surface of said developer bearing body; and wherein a curvature radius R (μm) of said outer surface of said bent portion and a mean crystal grain diameter D (μm) of said metal material satisfy the relationship:

$$60\times10^{-3}\times R-11\leqq D\leqq250\times10^{-3}\times R-35.$$

11. The developer regulating member according to claim 10, wherein said mean crystal grain diameter D is greater than or equal to 10 μm.

12. The developer regulating member according to claim 10, wherein said outer surface of said bent portion has an arithmetic mean surface roughness Ra in a range from 0.1 μm to 0.3 μm.

13. A developing device comprising said developer regulating member according to claim 10, and said developer bearing body.

14. The developing device according to claim 13, wherein:

said developer bearing body is a roller having a resilient outer layer;

said resilient outer layer has an ASKER-C hardness in a range from 65° to 85°; and said resilient outer layer has ten-point surface roughness in a range from 2 to 10 μm and arithmetic mean roughness in a range from 0.4 to 1.4 μm.

15. The developing device according to claim 13, wherein said developer regulating member is urged against said developer bearing body with a linear pressure in a range from 10 to 50 N/m.

16. The developing device according to claim 13, further comprising a latent image bearing body that bears a latent image to be developed by said developer bearing body.

17. An image forming apparatus comprising said developing device according to claim 16.

18. A manufacturing method, comprising:

providing a developer regulating member that regulates a thickness of a layer of a developer having a degree of circularity in a range from 0.98 to 0.99 on a surface of a developer bearing body, the developer regulating member including a resilient plate member composed of a metal material and having a bent portion;

wherein an outer surface of said bent portion contacts said surface of said developer bearing body so that a ridge line of said outer surface of said bent portion crosses a moving direction of said surface of said developer bearing body;

wherein a curvature radius R (μm) of said outer surface of said bent portion and a mean crystal grain diameter D (μm) of said metal material satisfy the relationship:

$$60\times10^{-3}\times R-11\leqq D\leqq250\times10^{-3}\times R-35;\text{ and}$$

wherein forming said plate member by a rolling process of said metal material so that a thickness ts of said metal material before said rolling process and a thickness tp of said metal material after said rolling process satisfy the relationship:

$$ts\geqq3\times tp.$$

* * * * *